US009001206B2

(12) United States Patent
Wang et al.

(10) Patent No.: US 9,001,206 B2
(45) Date of Patent: Apr. 7, 2015

(54) CASCADABLE CAMERA TAMPERING DETECTION TRANSCEIVER MODULE

(75) Inventors: Shen-Zheng Wang, Taoyuan (TW); San-Lung Zhao, Hsinchu (TW); Hung-I Pai, Taipei (TW); Kung-Ming Lan, Yilan (TW); En-Jung Farn, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 710 days.

(21) Appl. No.: 13/214,415

(22) Filed: Aug. 22, 2011

(65) Prior Publication Data

US 2012/0154581 A1 Jun. 21, 2012

(30) Foreign Application Priority Data

Dec. 16, 2010 (TW) ..... 99144269 A

(51) Int. Cl.
*G08B 13/196* (2006.01)
*G08B 29/04* (2006.01)

(52) U.S. Cl.
CPC ..... *G08B 13/196* (2013.01); *G08B 29/046* (2013.01)

(58) Field of Classification Search
CPC ..... G06K 9/00711; G06K 9/00771
See application file for complete search history.

(56) References Cited

U.S. PATENT DOCUMENTS 7,508,941 B1 * 3/2009 O'Toole et al. ..... 380/228
8,558,889 B2 * 10/2013 Martin et al. ..... 348/143
2010/0026802 A1 2/2010 Titus et al.

FOREIGN PATENT DOCUMENTS

WO WO-2008150517 A1 12/2008

OTHER PUBLICATIONS

Cavallaro, A. and T. Ebrahimi, "Video object extraction based on adaptive background and statistical change detection", Visual Communications and Image Processing 2001, Proceedings of SPIE vol. 4310, 2001.*

Xu, L-Q, J. Landabaso, and B. Lei, "Segmentation and tracking of multiple moving objects for intelligent video analysis", BT Technology Journal, vol. 22, No. 3, Jul. 2004.*

* cited by examiner

*Primary Examiner* — William C Vaughn, Jr.
*Assistant Examiner* — Jerry Jean Baptiste
(74) *Attorney, Agent, or Firm* — Rabin & Berdo, P.C.

(57) ABSTRACT

A cascadable camera tampering detection transceiver module has a processing unit and a storing unit, an information controlling module and an analyzing module. The storing unit stores a transceiving module. The detection module analyzes input video, detects camera tampering events, synthesizes the input video with the image of camera tampering result, and outputs the synthesized video. When the input video is an output from the detection module, the detection module separates the camera tampering result from the input video, and the result can be used to simplify or enhance the subsequent video analysis. Performing the existing analysis repeatedly may be avoided, and the user may re-define the detection conditions in this manner. When the camera tampering result is transmitted in the video channel, the detection module transmits the camera tampering result, and hence the detection module may be used in combination with surveillance devices having image output or input interfaces.

18 Claims, 18 Drawing Sheets

| | View Field Change Property | Out-Of -Focus Property | Brightness Estimation Property | Color Estimation Property | . . . | Region Of Interest |
|---|---|---|---|---|---|---|
| ☑Covered<br>☐DO1☑DO2 | 500~100 | 500~100 | 0~50 | 0~30 | . . . | ROI<br>ROI |
| ☐Focus Failure<br>☐DO1☐DO2 | N/A | 80~100 | N/A | N/A | . . . | ROI |

FIG. 14

| | Movement Estimation Property | ... | DI1 | Region Of Interest |
|---|---|---|---|---|
| ☑Rope-Tripping 1<br>☐DO1☑DO2 | 500~100 | ... | N/A | |
| ☑Rope-Tripping 2<br>☐DO1☑DO2 | N/A | ... | ON | N/A |

FIG. 15

CASCADABLE CAMERA TAMPERING DETECTION TRANSCEIVER MODULE

CROSS-REFERENCE TO RELATED APPLICATION

The present application is based on, and claims priority from, Taiwan Patent Application No. 99144269, filed Dec. 16, 2010, the disclosure of which is hereby incorporated by reference herein in its entirety.

TECHNICAL FIELD

The present disclosure generally relates to a cascadable camera tampering detection transceiver module.

BACKGROUND

The rapid development of video analysis technologies in recent years has made the smart video surveillance an important issue in security. One common surveillance issue is that the surveillance camera may be subject to sabotage or tampering in certain way to change the captured views, such as, moving the camera lens to change the shooting angle, spraying paints to the camera lens, changing the focus or the ambient lighting source, and so on. All the above changes will severely damage the surveillance quality. Therefore, if the tampering can be effectively detected and the message of tampering detection can be passed to related surveillance personnel, the overall effectiveness of the surveillance systems may be greatly enhanced. Hence, how to detect camera tampering event and transmitting tampering information has become an important issue faced by smart surveillance application.

The video surveillance system currently available in the market may be roughly categorized as analog transmission surveillance based on analog camera with digital video recorder (DVR), and digital network surveillance based on network camera with network video recorder (NVR). According to the survey by IMS Research on the market size in 2007, the total shipment amounts of analog cameras, network camera, DVR and NVR are 13838000, 1199000, 1904000 and 38000 sets, respectively. In 2012, the market is expected to grow to 24236000, 6157000, 5184000, and 332000 sets, respectively. From the above industrial information, the analog transmission surveillance is still expected to stay as the mainstream of the surveillance market for the next several years. In addition, the users currently using analog transmission surveillance solutions are unlikely to replace the current systems. Therefore, the analog transmission surveillance will be difficult to be replaced in the next several years. On the other hand, the digital network surveillance system may also grow steadily. Therefore, how to cover both analog transmission surveillance and digital network surveillance solutions remains a major challenge to the video surveillance industry.

The majority of current camera tampering systems focus on the sabotage detection of the camera. That is, the detection of camera sabotage is based on the captured image. These systems can be classified as transmitting-end detection or receiving-end detection. FIG. 1 shows a schematic view of transmitting-end detection system. As shown in FIG. 1, transmitting-end detection system will relay the video image signal from the camera for camera sabotage detection, store the sabotage detection result to a front-end storage medium, and provide a server for inquiry (usually a web server). In this case, the receiving-end needs to inquire the sabotage result information in addition to receiving video images so as to display the sabotage information to the user. The problem of this type of deployment is that the detection signal and the video image are transmitted separately, and will incur additional routing and deployment costs. FIG. 2 shows a schematic view of receiving-end detection system. As shown in FIG. 2, the receiving-end detection system transmits the video signal to the receiving-end and then performs the camera sabotage detection. In this manner, the receiving-end usually must be capable of processing video inputs from a plurality of cameras and performing user interface operation, display, storing and sabotage detection. Therefore, the hardware requirement for the receiving-end is higher and usually needs a high computing-power computer.

Taiwan Publication No. 200830223 disclosed a method and module for identifying the possible tampering on cameras. The method includes the steps of: receiving an image for analysis from an image sequence; transforming the received image into an edge image; generating a similarity index indicating the similarity between the edge image and a reference edge image; and if the similarity index is within a defined range, the camera may be tampered. This method uses the comparison of two edge images for statistical analysis as a basis for identifying the possible camera tampering. Therefore, the effectiveness is limited.

U.S. Publication No. US2007/0247526 disclosed a camera tamper detection based on image comparison and moving object detection. The method emphasizes the comparison between current captured image and the reference image, without feature extraction and construction of integrated features.

U.S. Publication No. US2007/0126869 disclosed a system and method for automatic camera health monitoring, i.e., a camera malfunction detection system based on health records. The method stores the average frame, average energy and anchor region information as the health record, and compares the current health record against the stored records. When the difference reaches a defined threshold, the tally counter is incremented. When the tally counter reaches a defined threshold, the system is identified as malfunctioning. The method is mainly applied for malfunction determination, and is the same as Taiwan Publication No. 200830223, with limited effectiveness.

As aforementioned, the surveillance systems available in the market usually transmit the image information and change information through different channels. If the user needs to know the accurate change information, the user usually needs to use the software development kit (SDK) corresponding to the devices of the system. When an event occurs, some surveillance systems will display some visual warning effect, such as, flashing by displaying an image and a full-white image alternatingly, or adding a red frame on the image. However, all these visual effects are only for warning purpose. When the smart analysis is performed at the front-end device, the back-end device is only warned of the event, instead of knowing the judgment basis or reusing the computed result to avoid the computing resource waste and improve the efficiency.

Furthermore, as a surveillance system is often deployed in phases. Therefore, the final surveillance system may include surveillance devices from different manufacturers with vastly different interfaces. In addition, as the final surveillance system grows larger in scale, more and more smart devices and cameras will be connected. If all these smart devices must repeat the analysis and computing that other smart devices have done, the waste would be tremendous. As video image is an essential part of the surveillance system planning and deployment, most of the devices will deal with video transmission interface. If the video analysis information can be obtained through the video channel to enhance or facilitate the subsequent analysis via reusing prior analysis information and highlighted graphic display is used to inform the user of the event, the flexibility of the surveillance system can be vastly improved.

SUMMARY

The present disclosure has been made to overcome the above-mentioned drawback of conventional surveillance systems. The present disclosure provides a cascadable camera tampering detection transceiver module. The cascadable camera tampering detection transceiver module comprises a processing unit and a storage unit, wherein the storage unit further includes a camera tampering image transceiving module, an information control module and a camera tampering analysis module, to be executed by the processing unit. The camera tampering image transceiving module is responsible for detecting whether the inputted digital video data from the user having camera tampering image outputted by the present invention, and separating the camera tampering image and reconstructing the image prior to the tampering (i.e., video reconstruction) to further extract the camera tampering features. Then, the information control module stores the tampering information for subsequent processing to add or enhance the camera tampering analysis to achieve the objects of the cascadable camera tampering analysis and avoid repeating the previous analysis. If camera tampering analysis is needed, the camera tampering analysis module will perform the analysis and transmit the analysis result to the information control module. After information control module confirms the completion of the required analysis, the camera tampering image transceiving module makes the image of camera tampering features and synthesizes with the source video or the reconstructed video for output. By making an image of the tampering information and synthesis with video to form video output with tampering information, the present invention can achieve the object of allowing the user to see the tampering analysis result in the output video. Also, the display style used in the exemplary embodiments of the disclosure allow the current digital surveillance system to use the existing functions, such as moving object detection, to record, search or display tampering events.

In the exemplary embodiments of the present disclosure, the verify the practicality of camera tampering transceiver module uses a plurality of image analysis features and defines how to transform the image analysis features into the camera tampering features of the present disclosure. The image analysis features used in the present disclosure may include the use of the characteristics of the histogram that are not easily affected by the moving objects and noise in the environment to avoid the false alarm because of the moving object in a scene, and the use of image region change amount, average grey-scale change amount and moving vector to analyzes different types of camera tampering. Through the short-term feature and far-term feature comparison, not only the impact caused by the gradual environmental change can be avoided, but the update of the short-term feature can also avoid the misjudgment caused by the moving object temporarily close to the camera. According to the exemplary embodiments of the present disclosure, a plurality of camera tampering features transformed from image analysis features may be used to define camera tampering, instead of using fixed image analysis features, single-image or statistic tally of single-images to determine that the camera is tampered. The result is better than the conventional techniques, such as, comparison of two edge images.

Therefore, the cascadable camera tampering detection transceiver module of the present disclosure requires no transmission channel other than the video channel to warn the user of the event as well as to propagate the information of the event and other quantified information and to perform cascadable analysis.

The foregoing and other features, aspects and advantages of the present disclosure will become better understood from a careful reading of a detailed description provided herein below with appropriate reference to the accompanying drawings.

BRIEF DESCRIPTION OF THE DRAWINGS

FIG. 14 shows a schematic view of an exemplary embodiment using a table to describe camera tampering event data set according to one exemplary disclosed embodiment.

FIG. 15 shows a schematic view of an exemplary embodiment inputting a general purpose input/output (GPIO) input signal according to one exemplary disclosed embodiment.

DETAILED DESCRIPTION OF DISCLOSED EMBODIMENTS

Figure 1:
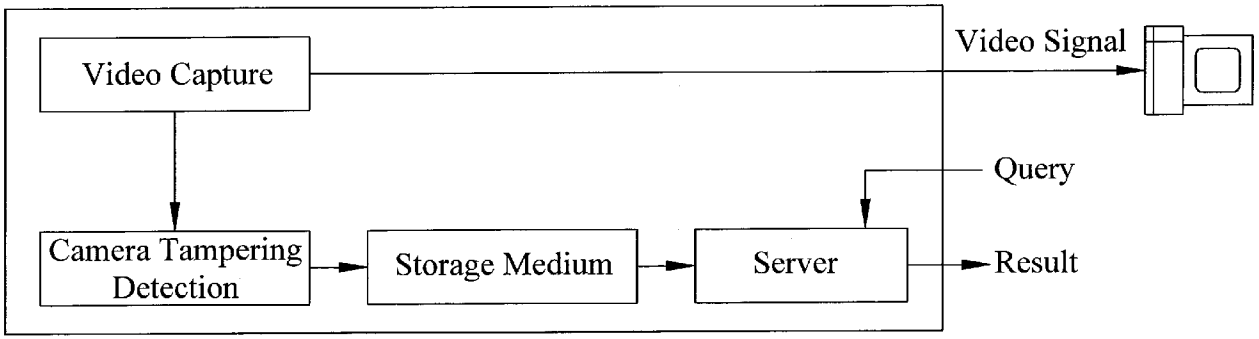
FIG. 1 shows a schematic view of transmitting-end detection system.
Figure 2:
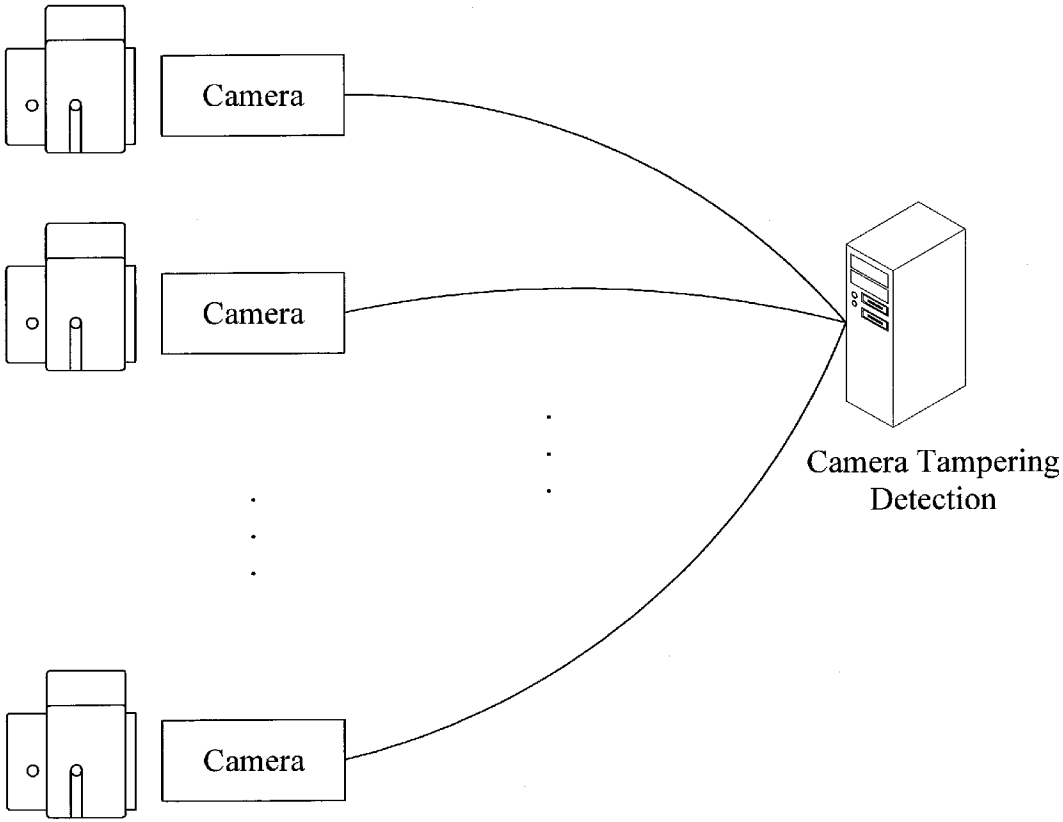
FIG. 2 shows a schematic view of receiving-end detection system.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
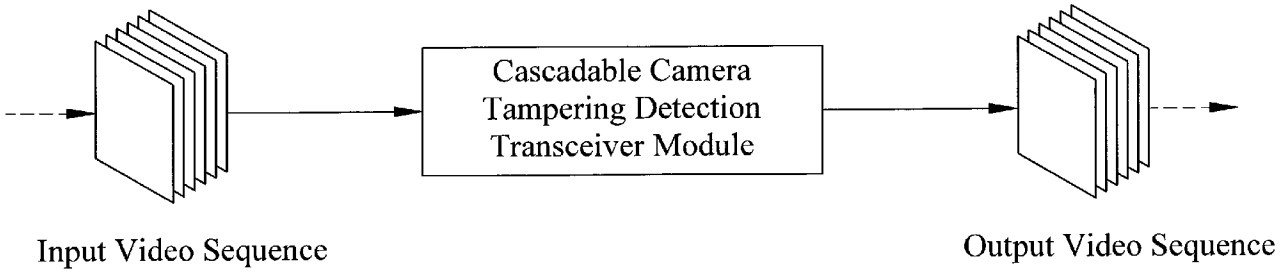
FIG. 3 shows a schematic view of the application of a cascadable camera tampering detection transceiver module according to one exemplary disclosed embodiment.

FIG. 3 shows a schematic view of the application of a cascadable camera tampering detection transceiver module according to one exemplary disclosed embodiment. As shown in FIG. 3, a cascadable camera tampering detection transceiver module is to receive an input image sequence, analyzes and determine the results, and outputs an image sequence.

Figure 4:
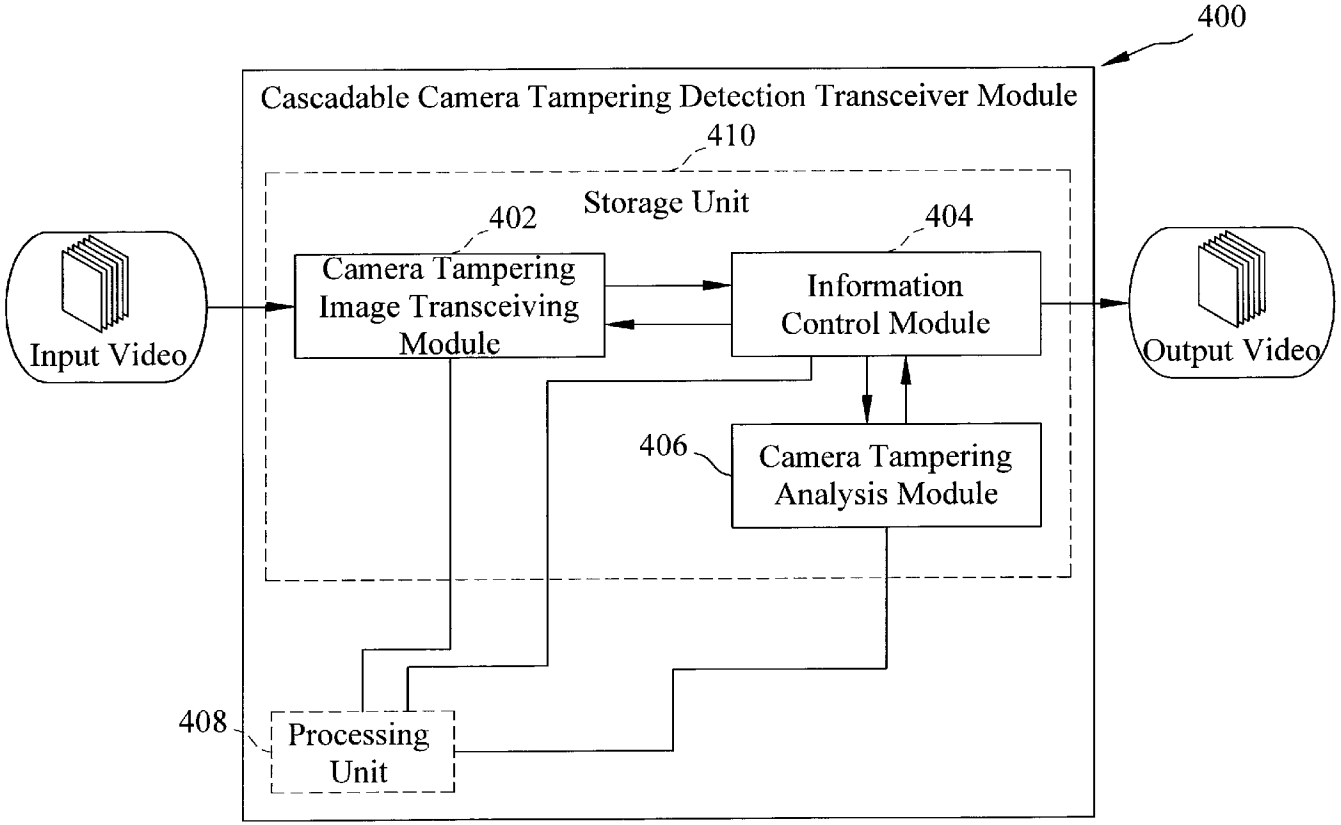
FIG. 4 shows a schematic view of a structure of a cascadable camera tampering detection transceiver module according to one exemplary disclosed embodiment.

FIG. 4 shows a schematic view of a structure of a cascadable camera tampering detection transceiver module according to one exemplary disclosed embodiment. As shown in FIG. 4, cascadable camera tampering detection transceiver module 400 comprises a processing unit 408 and a storage unit 410. Storage unit 410 further stores a camera tampering image transceiving module 402, an information control module 404 and a camera tampering analysis module 406. Processing unit 408 is responsible for executing camera tampering image transceiving module 402, information control module 404 and camera tampering analysis module 406 stored in storage unit 410. Camera tampering image transceiving module 402 is responsible for detecting whether the inputted digital video data from the user having camera tampering image outputted by the present invention, and separating the camera tampering image and reconstructing the image prior to the tampering (i.e., video reconstruction) to further extract the camera tampering features. Then, information control module 404 stores the tampering information for subsequent processing to add or enhance the camera tampering analysis to achieve the objects of the cascadable camera tampering analysis and avoid repeating the previous analysis. If camera tampering analysis is needed, camera tampering analysis module 406 will perform the analysis and transmit the analysis result to information control module 404. After information control module 404 confirms the completion of the required analysis, camera tampering image transceiving module 402 makes the image of camera tampering features and synthesizes with the source video or the reconstructed video for output. By making an image of the tampering information and synthesis with video to form video output with tampering information, the present invention can achieve the object of allowing the user to see the tampering analysis result in the output video. Also, the display style used in the present invention allows the current digital surveillance system (DVR) to use the existing functions, such as moving object detection, to record, search or display tampering events.

Figure 5:
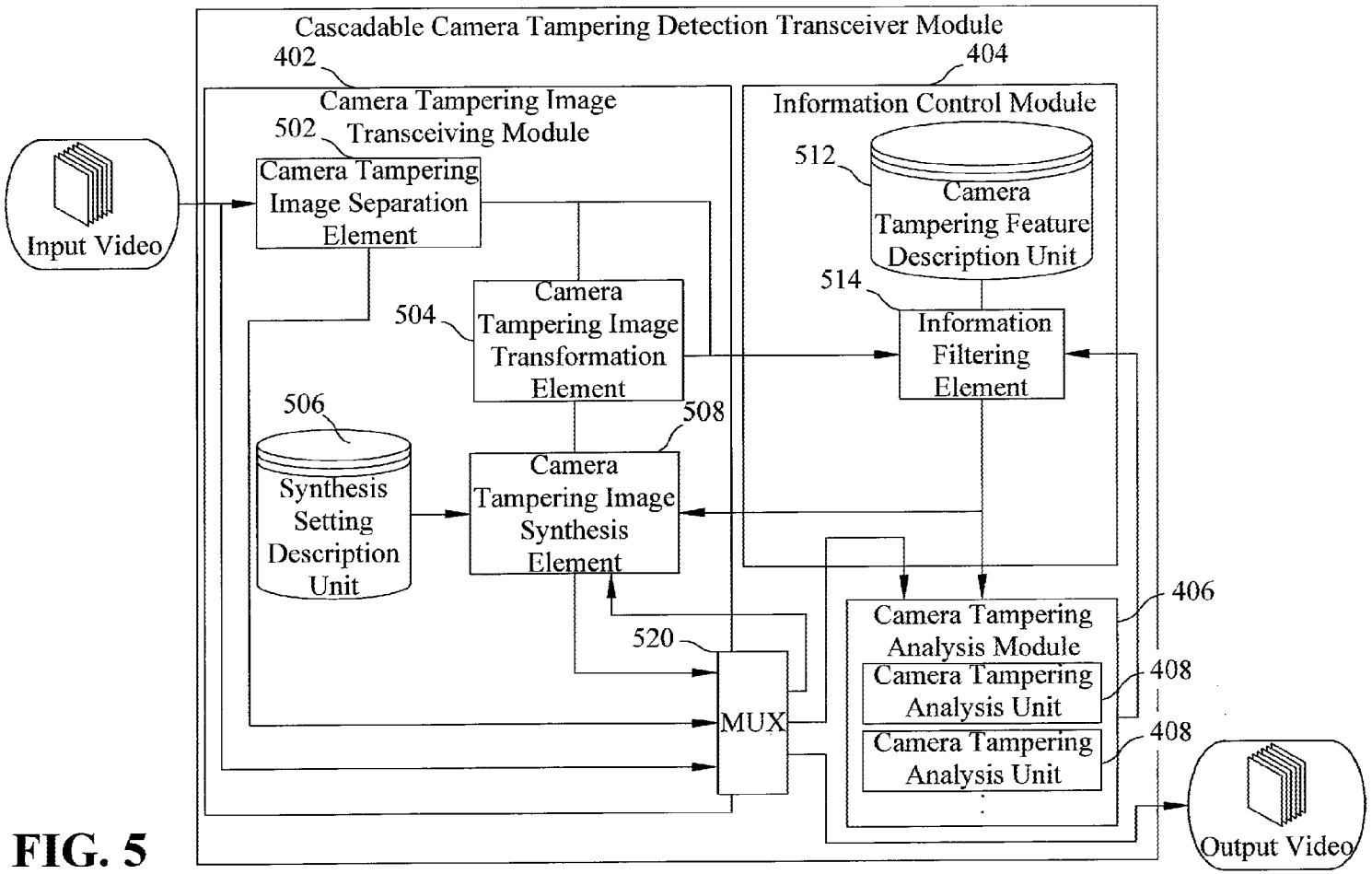
FIG. 5 shows a schematic view of the operation among camera tampering image transceiving module, information control module and camera tampering analysis module of the cascadable camera tampering detection transceiver module according to one exemplary disclosed embodiment.

FIG. 5 shows a schematic view of the operation among camera tampering image transceiving module, information control module and camera tampering analysis module of the cascadable camera tampering detection transceiver module according to one exemplary disclosed embodiment. As shown in FIG. 5, camera tampering image transceiving module 402 of cascadable camera tampering detection transceiver module 400 further includes a camera tampering image separation element 502, a camera tampering image transformation element 504, a synthesis setting description unit 506 and a camera tampering image synthesis element 508. Camera tampering image separation element 502 is for receiving input video and separating video and tampered image. If image is tampered, camera tampering image transformation element 504 will transform the tampered image into tampering features and perform reconstruction of input image. Then, the image reconstruction and tampering features will be processed by information control module 404 and camera tampering analysis module 406. After processing, camera tampering image synthesis element 508 of camera tampering image transceiving module 402 will synthesize the image according to the synthesis specification described in synthesis setting description unit 506, and output the final synthesized video. It is worth noting that the output image from camera tampering image transceiving module 402 can be from camera tampering image synthesis element 508, camera tampering image separation element 502, or the original source input video. The above three sources of output image can be connected to the output of information control module 404 and the input of camera tampering analysis module 406 through a multiplexer 520 according to the computation result. The method of how decide which of the above three sources of the output image from camera tampering image transceiving module 402 will be connected respectively to the output of information control module 404 and the input of camera tampering analysis module 406 will be described in details in the following description of information control module 404 and information filtering element 514.

Similarly, information control module 404 further includes a camera tampering feature description unit 512 and an information filtering element 514, wherein camera tampering feature description unit 512 is for storing the information of camera tampering feature, and information filtering element 514 is responsible for receiving and filtering the request from camera tampering image transformation element 504 to access the tampering feature stored at camera tampering feature description unit 512 and determining whether to activate camera tampering analysis module 406. On the other hand, camera tampering analysis module 406 further includes a plurality of camera tampering analysis units for different analyses, and feeds back the analysis result to information filtering element 514 of information control module 404.

The following will describe the operations of camera tampering image transceiving module 402, information control module 404 and camera tampering analysis module 406 including camera tampering analysis units 408 in detail.

As aforementioned, camera tampering image transceiving module 402 is to transform the camera tampering features into a barcode image, such as, the QR code, PDF417 or Chinese Sensible Code of the 2-dimensional barcode. The barcode image is then synthesized with the video for output. Camera tampering image transceiving module 402 can also detect and transform the camera tampering image in video back to camera tampering feature or reconstruct the image. As shown in FIG. 5, when receiving input video, camera tampering image transceiving module 402 first uses camera tampering image separation element 502 to separate the video and the tampered image. Then, camera tampering image transformation element 504 transforms the tampered image into tampering feature and reconstructs the input image. The reconstructed image and the tampering feature are then processed by information control unit 404 and camera tampering analysis module 406. After the processing, camera tampering image synthesis element 508 of camera tampering image transceiving module 402 will synthesize the post-processed reconstructed image and tampering feature according to the synthesis specification described in synthesis setting description unit 506. Finally, the resulted synthesized video is outputted.

Figure 6:
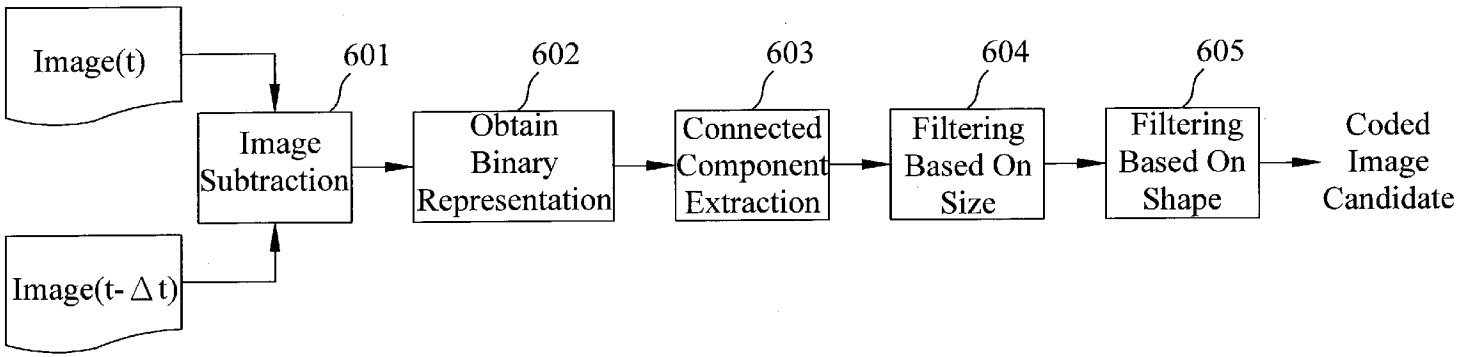
FIG. 6 shows a schematic view of a camera tampering image separation exemplar according to one exemplary disclosed embodiment.
Figure 7:
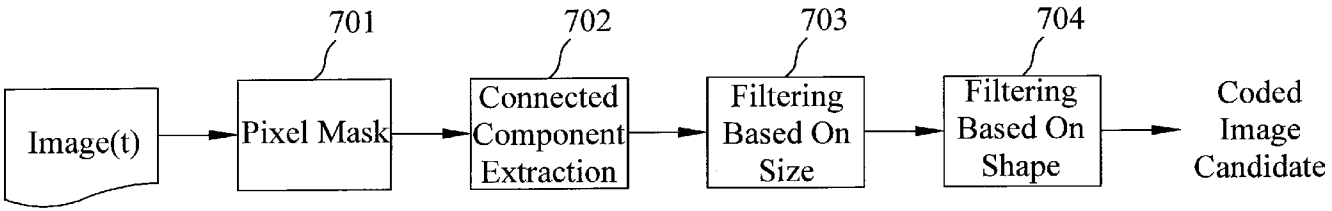
FIG. 7 shows a schematic view of another camera tampering image separation exemplar according to one exemplary disclosed embodiment.

After receiving input video, camera tampering image separation element 502 will first determine whether the input video contains camera tampering barcode. If so, the camera tampering barcode is located and extracted. FIG. 6 and FIG. 7 show schematic views of two different camera tampering image separation exemplars respectively.

As shown in FIG. 6, this exemplary embodiment takes two consecutive images, such as, image(t) and image(t−Δt) for image subtraction (label 601) to compute the difference of each pixel in the image. After using binary representation (label 602), a threshold is set to filter and find out the pixels with difference exceeding the threshold. Then, through the step of connected component extraction (label 603), the connected components formed by these pixels are found. The overly large or small parts in the connected components must not be coded image, and can be filtered out directly (label 604). According to the coding method used by the present invention, coded image is either rectangle or square. Therefore, by using the similarity between the number of points in the connected components and the square to filter the remaining area, the similarity is computed as $N_{pt}/(W\times H)$, where $N_{pt}$ is the number of points in the connected component, and W and H are farthest distance between the two points on horizontal axis and the vertical axis respectively. Finally, the result is the coded image candidate.

FIG. 7 shows a schematic view of an exemplar using the positioning mechanism based on the direct color filtering on the pixel. This type of positioning mechanism is suitable for the situation where the synthesized coded image includes some fixed colors (or grayscale values). Because the coded image is set to be binary image of two different colors, this mechanism can directly subtract each pixel from the set binary color point, such as, the pixel mask used by label 701 to compute the difference, and filer to find out the pixels meeting the requirements. The filtering equation is as follows:

$$\mathrm{Min}(|V(p)-V_B|,|V(p)-V_W|)>Th_{Code}$$

Where V(p) is the color of the p coordination point, $V_B$ and $V_W$ are the color values mapped to binary image 0 and 1 during synthesizing the coded image, and $Th_{Code}$ is the threshold sued to filter the color similarity. After filtering pixels, as the computation shown in the aforementioned FIG. 6, the method proceeds to find connected components (label 702) and subsequent size filtering (label 703) and shape filtering (label 704). Because all the above computation is to filter out the connected components that do not meet the criteria, it is possible to filer out all the connected components. When all the connected components are filtered out, the image is defined as not having any synthesized coded image. Hence, this image cannot be positioned and does not need to go through camera tampering image transformation element 504. Instead, this image can go to information filtering element 514 for next stage processing. On the other hand, if a plurality of connected components remain after filtering, these connected components are restored to original binary coded image according to the color rules set in coding. These binary area images become coded image candidates. Finally, the coded image candidates are passed to camera tampering image transformation element 504 for processing and then to information filtering element 514 for next stage processing.

Figure 8:
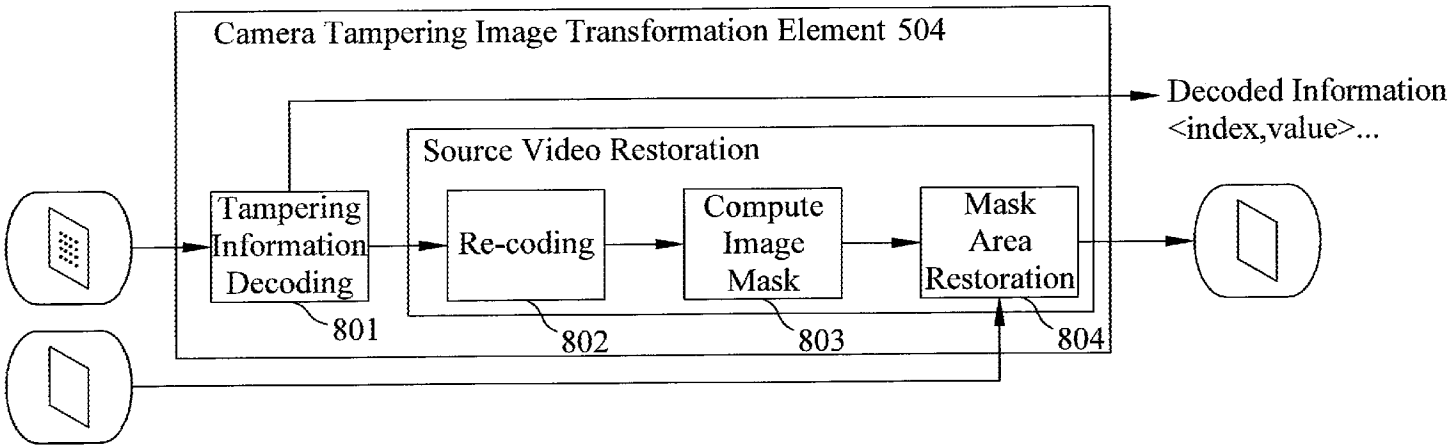
FIG. 8 shows a schematic flowchart of the process after camera tampering image transformation element receiving a camera tampering barcode image and a source image according to one exemplary disclosed embodiment.

FIG. 8 shows a schematic flowchart of the process after camera tampering image transformation element receiving a camera tampering barcode image and a source image according to one exemplary disclosed embodiment. Because the location and size of the camera tampering barcode image vary according to the coding settings, the positioning feature characteristics of the code must be used to extract the complete barcode image after obtaining coded image candidates. For example, the QR Code has the upper left corner, lower left corner and upper right corner as the positioning feature, PDF417 has two sides with long stripe areas as the positioning feature and Chinese-Sensible Code has the upper left corner, lower left corner, upper right corner and lower right corner of mixed line areas as the positioning feature. The barcode image must be positioned before the extraction. To position the barcode image, the first step is to find the pixel segments on the vertical or horizontal lines of video image. Then, the information on the starting and ending points of these segments is used to obtain the intersection relation among the segments. The information is used to merge the segments into the categories of line, stripe and block. According to the relative coordination positions of the lines, stripes and blocks to determine which lines, stripes and blocks can be combined to form positioning blocks for QR Code, positioning stripes for PDF417, or positioning mixed line blocks for Chinese-Sensible Code. Finally, all the positioning blocks/stripes/mixed line blocks of QR Code, PDF417 or Chinese-Sensible Code are checked for size and relative location to position the barcode image for QR Code, PDF417 or Chinese-Sensible Code in the video image. At this point, the barcode image positioning is complete, i.e., finishing tampering information decoding (label 801). After positioning, the barcode image is transformed into feature information by the image transformation element. Any coded image candidates unable to be positioned, extracted or transformed into any other information will be determined as misjudged coded image and discarded directly.

After the image is transformed back to feature information, image reconstruction is performed to restore to the source image. The image reconstruction is to remove the coded image from the video image to prevent the coded image from affecting the subsequent analysis and processing. After coding the decoded information (label 802) and computing image mask (label 803) to find the size and range of the coded image, the coded image can be removed from the input image by performing mask area restoration (label 804).

It is worth noting that the coded image area can be affected by noise or moving object in the frame during positioning to result in unstable area or noise in the synthesized image. Because the graphic barcode decoding rules allow certain errors and include correction mechanism, the areas with noise can also be correctly decoded to obtain source tampering information. When the source tampering information is decoded, another coding is performed to obtain the original appearance and size of the coded image at the original synthesis. In some of the synthesis modes adopted by the present invention, the synthesized coded image can be used to restore the input image to original captured image. Hence, the re-coded image is the clearest coded image for restoring to original captured image. In other synthesis modes, the original captured image may not be restored. At this point, the re-coded image area is set as image mask for replacing the masked area with a certain fixed color to avoid misjudgment caused by coded image area during analysis. The synthesis mode and the restoration method will be described in details when the tampering information synthesis element is described.

Figure 9:
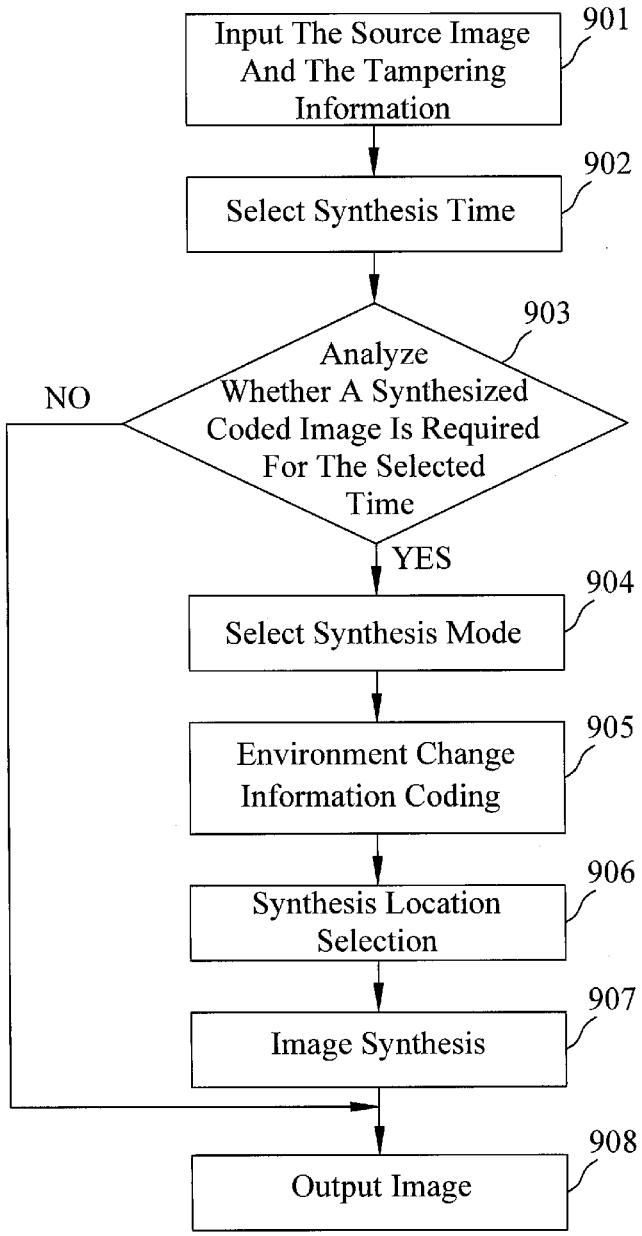
FIG. 9 shows a schematic flowchart of the operation of camera tampering image synthesis element.

FIG. 9 shows a schematic flowchart of the operation of camera tampering image synthesis element. After camera tampering image synthesis element 508 receives tampering feature from information control module 404 and input image from camera tampering image transformation element 504, camera tampering image synthesis element 508 makes an image of tampering feature and synthesizes into input image, and finally outputs the synthesized image.

Camera tampering image coding can use one of the following coding/decoding techniques to display the camera tampering feature as a barcode image: QR Code (1994, Denso-Wave), PDF417 (1991, Symbol Technologies) and Chinese-Sensible Code, wherein QR Code is an open standard, and the present invention is based on ISO/IEC18004 to generate QR Code; PDF417 is the two-dimensional barcode invented by Symbol Technologies, Inc., and the present invention is based on ISO15438 to generate PDF417; and Chinese-Sensible Code is a matrix-based two-dimensional barcode, and the present invention is based on GB/T21049-2007 specification to generate Chinese-Sensible Code. For any camera tampering feature, the present invention computes the required number of bits, determines the size of the two-dimensional barcode according to the selected two-dimensional barcode specification and required error-tolerance rate, and generates the two-dimensional barcode. The output video of the present invention will include visible two-dimensional barcode for storing tampering feature (including warning data). There are three modes for two-dimensional barcode to be synthesized into the image, i.e., non-fixed color synthesis mode, fixed-color synthesis mode and hidden watermark mode.

In the non-fixed color synthesis mode, the synthesized coded image will cause the change in source image. Some applications may want to restore the source image for using, and there are two modes to choose from when setting as restorable synthesis mode. The first mode is to perform transformation on the pixels by XOR operation with specific bit mask. In this manner, the restoration can be achieved by using the same bit mask for XOR operation. This mode may transform between black and white. The second mode is to use vector transformation. Assume that a pixel is a three-dimensional vector. The transformation of the pixel is by multiplying the pixel with a 3×3 matrix Q, and the restoration is to multiply the transformed pixel with the inverse matrix $Q^{-1}$. The vector transformation mode is applicable to black-and-white. The coded color and grayscale obtained by this mode is non-fixed. In aforementioned camera tampering image separation element 502, the image subtraction method must be used to position the coded area for restoration. On the other hand, in the fixed synthesis color mode, the synthesized coded image may be set to fixed color or complementary color of the background color so that the user can observe and detect more easily. When set as fixed color, the black and white of the coded image will be mapped to two different colors. When set as complementary color, or targeting black and white to set as complementary color of the background, the background color can stay unchanged. In addition, in the hidden watermark mode, the black and white in the coded image are mapped to different colors, and these colors are directly used in the image. The values of the color pixels covered by the coded area may be inserted into the other pixels in the image as invisible digital watermark. When restoring, the color or image subtraction can be used to position the location of the coded image, and then the invisible digital watermark is extracted from the other area of the image to fill the location of the coded image to achieve restoration.

FIG. 9 shows a flowchart of processing each frame of image in the video stream. As shown in FIG. 9, step 901 is to input the source image and the tampering information. Step 902 is to select synthesis time according to the tampering information. Step 903 is to analyze whether a synthesized coded image is required for the selected time; if not, the process proceeds to step 908 to output the source image directly. On the other hand, if synthesis is necessary, step 904 is to determine the display style of the coded image through the selection of synthesis mode. Step 905 is to perform coding and generating coded image through the environment change information coding. Then, step 906 is to select the location of the coded image through the synthesis location selection, and finally, step 907 is to place the coded image into the source image to accomplish the image synthesis. After synthesis, step 908 is to use the synthesized image as the current frame in the video for output.

It is worth noting that the coded image provides the back-end surveillance users to observe directly the occurrence of warning. To achieve the object, camera tampering image synthesis element 508 provides selections for synthesis location and synthesis time. The synthesis location selection has two types to select from, i.e., fixed selection and dynamic selection. The synthesis time selection can change flickering time and warning duration according to the setting. The following describes all the options of selection:

1. Fixed synthesis location selection: in this mode, the synthesis information is placed at a fixed location, and the parameter to be set is the synthesis location. When selecting this mode, the synthesis must be assigned, and the synthesized image appears only at the assigned location.
2. Dynamic synthesis location selection: in this mode, the synthesis information is dynamically placed at different locations to attract attention. More than one location can be assigned, and the order of these locations can also be set as well as the duration, so that the synthesized coded image will appear with movement effect at different speeds.
3. Synthesis time selection: The parameters to be set are flickering time and warning duration. The flickering time is the appearing time and the disappearing time of the synthesis coded information for the appearing state and disappearing state so that the viewer will see the synthesis coded information appearing and disappearing to achieve the flickering effect. The warning duration is a duration within which the action of synthesis coded information will stay on screen even no further camera tampering is detected so that the viewer has sufficient time to observe the action.

All the above set data will be stored in the format of <CfgID, CfgValue>, where CfgID is the set index, and CfgValue is the set value. CfgID may be index number corresponding to location, time and mode, while CfgValue is the data wherein:

1. CfgValue of location: is <Location+>, indicating one or more coordinate value sets. "Location" is the location coordinates. When there is only one Location, the fixed location synthesis is implied. A plurality of Locations implies the coded image will dynamically change locations among these locations.
2. CfgValue of time: is <BTime, PTime>. BTime is the cycle of appearing and disappearing of coded image, and PTime indicates the duration the barcode lasts after an event occur.
3. CfgValue of mode: is <ModeType, ColorAttribute>. ModeType is for selecting one of the index values of "non-fixed color synthesis mode", "fixed color synthesis mode", and "hidden watermark mode". ColorAttribute is to indicate the color of coded image when the mode is either fixed color synthesis or hidden watermark, and to indicate color mask or vector transformation matrix when the mode is non-fixed color synthesis mode.

As aforementioned, information control module 404 includes a camera tampering feature description unit 512 and an information filtering element 514. Camera tampering feature description unit 512 is a digital data storage area for storing camera tampering feature information, and can be realized with a harddisk or other storage device. Information filtering element 514 is responsible for receiving and filtering the request from camera tampering image synthesis element 508 to access camera tampering feature stored in camera tampering feature description unit 512, and determining whether to activate the functions of camera tampering analysis module 406. The following describes the details of information filtering element 514.

Figure 10:
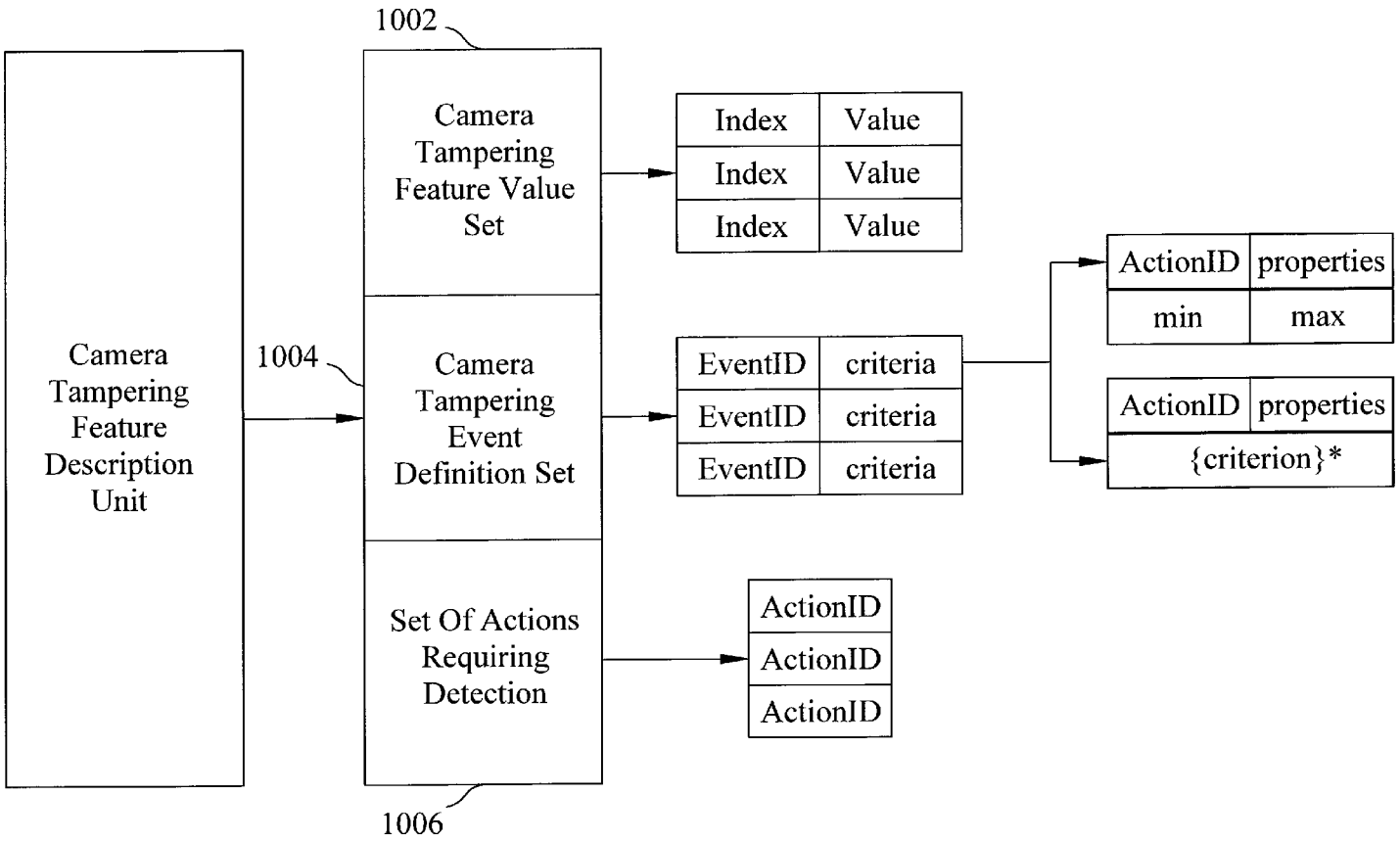
FIG. 10 shows a schematic view of an embodiment of the data structure stored in camera tampering feature description unit according to one exemplary disclosed embodiment.

FIG. 10 shows a schematic view of an embodiment of the data structure stored in camera tampering feature description unit according to one exemplary disclosed embodiment. As shown in FIG. 10, camera tampering feature description unit 512 stores a set 1002 of camera tampering feature values, a set 1004 of camera tampering event definitions 1004, and a set 1006 of actions requiring detection. Camera tampering feature value set 1002 further includes a plurality of camera tampering features, and each camera tampering feature is expressed as <index, value> tuple, wherein index is the index and can be an integer or a string data; value is the value corresponding to the index and can be Boolean, integer, floating point number, string, binary data or another pair. Therefore, camera tampering feature value set 1002 can be expressed as {<index, value>*}, wherein "*" indicates the number of elements in this set can be zero, one or a plurality. Camera tampering event definition set 1004 further includes a plurality of camera tampering events. Each camera tampering event is expressed as <EventID, criteria> tuple, wherein EventID is index able to map to camera tampering feature, indicating the event index, and may be integer or string data; criteria is value able to map to camera tampering feature, indicating the event criteria corresponding to the event index. Furthermore, criteria can be expressed as <ActionID, properties, min, max> tuple. ActionID is an index indicating a specific feature, and can be an integer or a string data; properties is the feature attributes; min and max are condition parameters indicating the minimum and the maximum thresholds, and can be Boolean, integer, floating point number, string or binary data. Alternatively, criteria can be expressed as <ActionID, properties, {criterion}> tuple. Criterion can be Boolean, integer, floating point number, ON/OFF or binary data. "*" indicates that the number of elements in the set can be zero, one or a plurality. In addition, properties is defines as (1) region of interest, and region is defined as pixel set or (2) requiring or not requiring detection, and can be Boolean or integer. Finally, Set 1006 of actions requiring detection is expressed as {ActionID*}, and "*" indicates that the number of elements in the set can be zero, one or a plurality. The set consists of ActionIDs having event criteria with "requiring detection".

Figure 11:
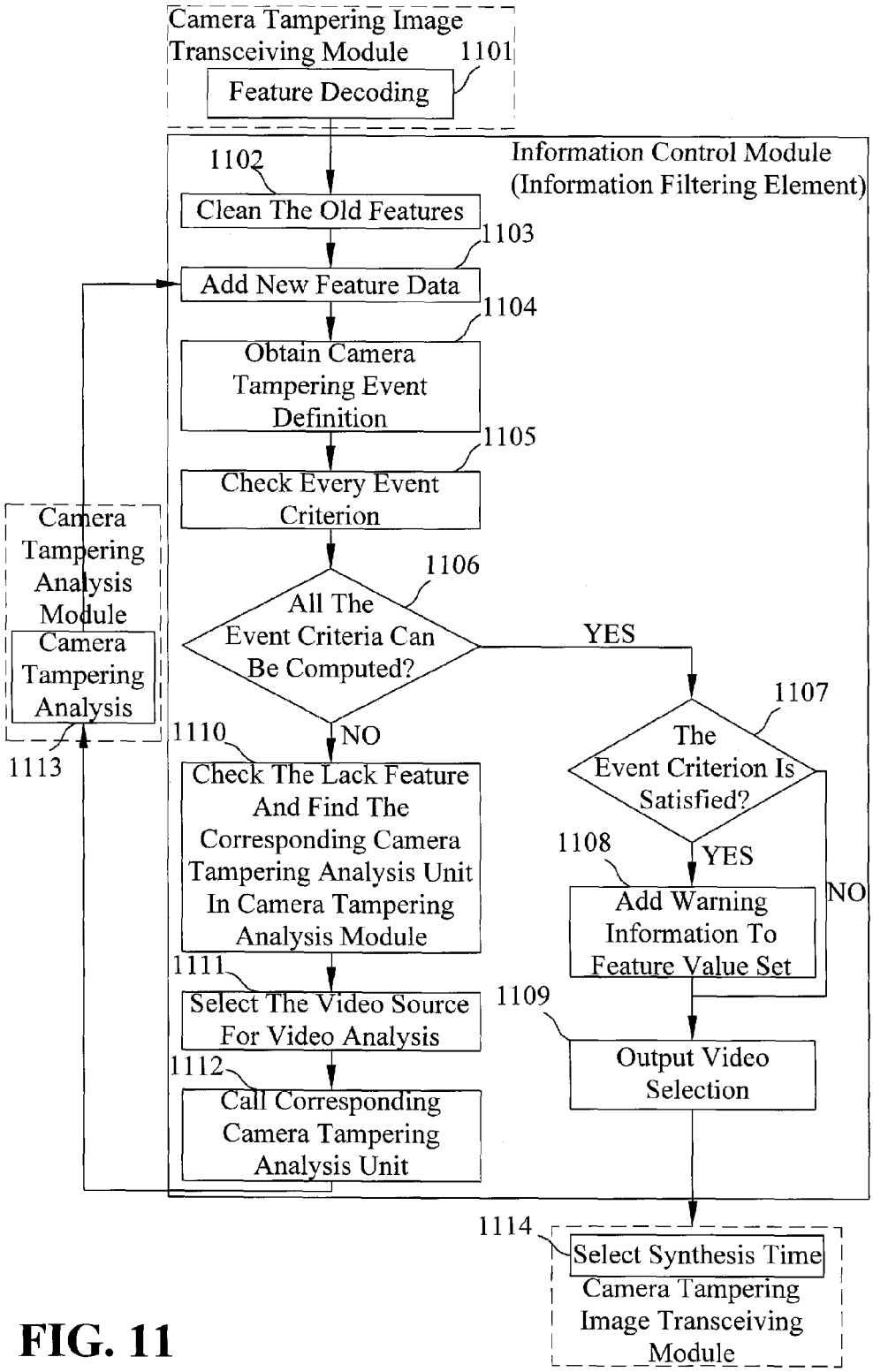
FIG. 11 shows a flowchart of the operation after information control module receiving image and tampering feature separated by camera tampering image transceiving module according to one exemplary disclosed embodiment.

FIG. 11 shows a flowchart of the operation after information control module receiving image and tampering feature separated by camera tampering image transceiving module according to one exemplary disclosed embodiment. As shown in FIG. 11, in step 1101, camera tampering image transceiving module 402 finishes feature decoding. Step 1102 is for information filtering element 514 of information control module 404 to clean the old features by deleting the old analysis results and data no longer useful in camera tampering feature description unit 512, and step 1103 is for information filtering element 514 to add new feature data by storing received tampering features to camera tampering feature description unit 512. Step 1104 is for information filtering element 514 to obtain camera tampering event definition from camera tampering feature description unit 512. Then, step 1105 is for information filtering element 514 to check every event criterion; that is, according to the obtained tampering event definition, list each event criterion and search for corresponding camera tampering feature value tuple in camera tampering feature description unit 512 according to the event criterion. Then, step 1106 is to determine whether all the event criteria can be computed, that is, to check whether the feature value tuples of all the event criteria of a tampering event definition are stored in camera tampering feature description unit 512. If so, the process proceeds to step 1107; otherwise, the process proceeds to step 1110. Step 1107 is to determine whether the event criterion is satisfied, that is, when all the event criteria of all the event definitions are determined to be computable, each event criterion of each event definition can be computed individually to determine whether the criterion is satisfied. If so, the process executes step 1108 and then step 1109; otherwise, the process executes step 1109 directly. Step 1108 is for information filtering element 514 to add warning information to feature value set. When the event criterion of an event is satisfied, a new feature data <index, value> is added, wherein index is the feature number corresponding to the event and value is the Boolean True. Step 1009 is for information filtering element 514 to output video selection. Information filtering element 514 must select video that must be outputted according to the user-set output video selections, and transmit to camera tampering image transceiving module 402. Then, in step 1114, camera tampering image transceiving module 402 performs image synthesis and output, starting with selecting synthesis time. On the other hand, when not all the event criteria are computable (in step 1106), step 1110 is for information filtering element 514 to check the lack feature and find the corresponding camera tampering analysis unit in camera tampering analysis module 406. That is, when a tampering feature is lacking, the tampering feature number will be used to search for corresponding camera tampering analysis unit to perform analysis to obtain the required tampering feature. Step 1111 is for information filtering element 514 to select the video source for video analysis according to the user setting before calling the analysis unit. Step 1112 is for information filtering element 514 to call corresponding camera tampering analysis unit after the video selection. Step 1113 is for the corresponding camera tampering analysis unit in camera tampering analysis module 406 to perform camera tampering analysis and use information filtering element 512 to add the analysis result to camera tampering feature description unit 514, as shown in step 1105.

In summary, information filtering element 514 uses the required information obtained from camera tampering feature description unit 512 and passes to corresponding processing unit for processing. Information filtering element 514 is able to execute the function functions:

1. Add, set or delete the features in camera tampering feature description unit.
2. Provide the default values to the camera tampering feature value set inside the camera tampering feature description unit.
3. Provide the determination mechanism for calling camera tampering analysis module, further includes:
   3.1 obtain the ActionID set that requires determination in camera tampering feature description unit;

3.2 for each element in ActionID set that requires determination, obtain the corresponding value in camera tampering feature description unit to obtain the {<ActionID, corresponding_value>+} value set;

3.3 if any element in ActionID set that requires determination unable to obtain corresponding value, the {<ActionID, corresponding_value>+} is passed to camera tampering analysis module for execution, and waits until camera tampering analysis module completes execution; and 3.4 check whether camera tampering event <EventID, criteria> satisfies the corresponding criteria:

(i) if corresponding criteria is <ActionID, properties, min, max> tuple, the corresponding property value of ActionID must be between min and max to satisfy the criteria.

(ii) if corresponding criteria is <ActionID, properties, {criterion*}> tuple, the corresponding property value of ActionID must be within {criterion*} to satisfy the criteria.

4. Provide the determination mechanism for calling camera tampering image transceiving module. When all the camera tampering events requiring detection are determined, the execution is passed to the camera tampering image synthesis element of the camera tampering image transceiving module.

5. Provide the determination mechanism for input video to camera tampering analysis module:

5.1 When the user or the information filtering element defines that output reconstruction is required, such as, information filtering element detecting new video input, the input video is connected to the output of the camera tampering image separation element of the camera tampering image transceiving module.

5.2 When the user or the information filtering element defines that the source video should be outputted, the input video is connected to the input video of the camera tampering image transceiving module.

6. Provide determination mechanism for output video:

6.1 When the user or the information filtering element defines that the synthesized video should be outputted, such as, after information filtering element determining all the events, the output video is connected to the output of the camera tampering image synthesis element of the camera tampering image transceiving module.

6.2 When the user or the information filtering element defines that output reconstruction is required, such as, information filtering element detecting new video input, the output video is connected to the output of the camera tampering image separation element of the camera tampering image transceiving module.

6.3 When the user or the information filtering element defines that the source video should be outputted, the output video is connected to the input video of the camera tampering image transceiving module.

7. Provide the determination mechanism for input video to camera tampering image synthesis element:

7.1 When the user or the information filtering element defines that output reconstruction is required, the input video is connected to the output of the camera tampering image separation element of the camera tampering image transceiving module.

7.2 When the user or the information filtering element defines that the source video should be outputted, the input video is connected to the input video of the camera tampering image transceiving module.

Figure 12:
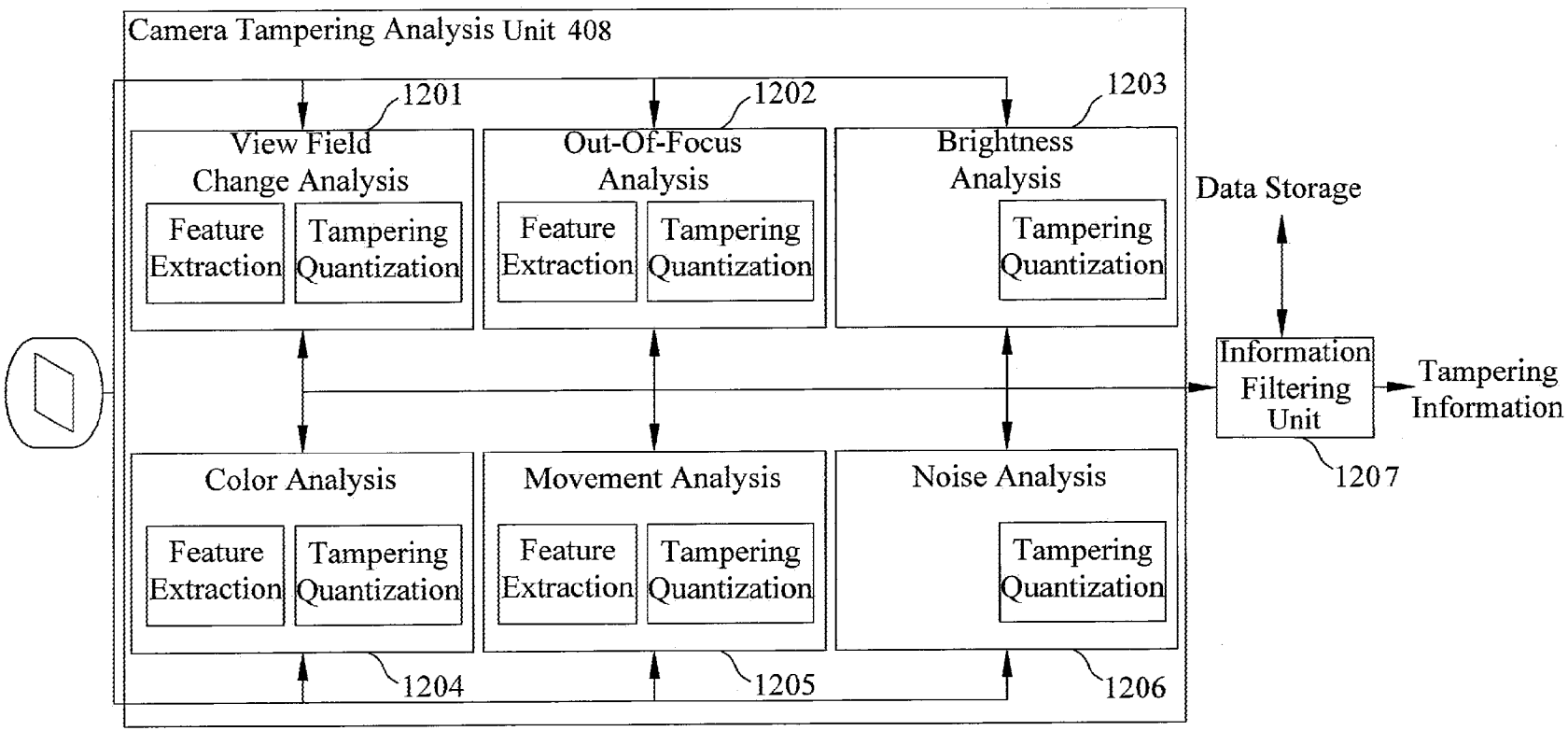
FIG. 12 shows a schematic view of the camera tampering analysis units according to one exemplary disclosed embodiment.

As aforementioned, camera tampering analysis module 406 further includes a plurality of tampering analysis units. For example, camera tampering analysis module 406 may further be expressed as {,ActionID, camera_tampering_analysis_unit>}, wherein ActionID is the index and can be integer or string data. The camera tampering analysis unit can analyze the input video, compute the required features or ActionID corresponding value (also called quantized value). The data is defined as camera tampering feature <index, value> tuple, wherein index is index value or ActionID, and value is feature or the quantized value. The feature or the quantized value to be accessed by camera tampering analysis unit are stored in camera tampering feature description unit 512 and the access must go through information control module 404. Different camera tampering analysis units can perform different feature analysis. The following describes the different camera tampering analysis units with different exemplars. As shown in FIG. 12, camera tampering analysis units 408 include view-field change feature analysis 1201, out-of-focus estimation feature analysis 1202, brightness estimation feature analysis 1203, color estimation feature analysis 1204, movement estimation feature analysis 1205 and noise estimation feature analysis 1206. The results from analysis are transformed into tampering information or stored by information filtering unit 1207.

Figure 13:
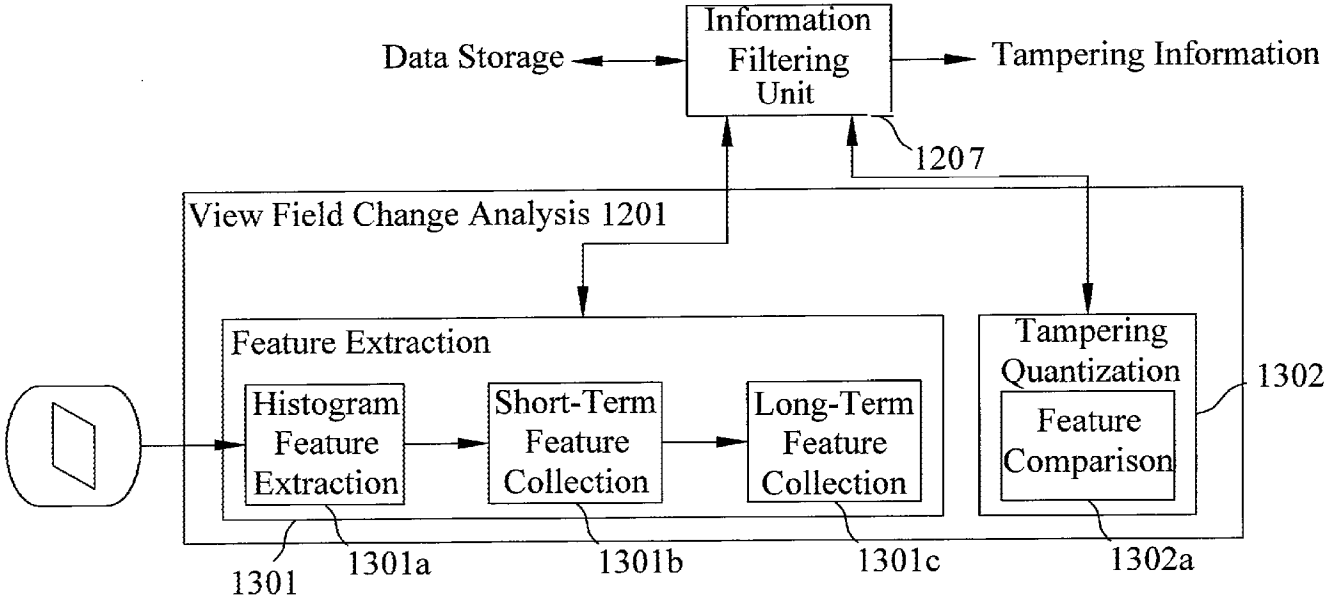
FIG. 13 shows a schematic view of the algorithm of the view-field change feature analysis according to one exemplary disclosed embodiment.

FIG. 13 shows a schematic view of the algorithm of the view-field change feature analysis according to one exemplary disclosed embodiment. After obtaining the video input, three types of feature extractions are performed (labeled 1301): individual histograms for Y, Cb, Cr components; the histogram for the vertical and horizontal edge strength; and histograms for the difference between the maximum and the minimum of Y, Cb, Cr components (labeled 1301*a*). These features will be collected through short-term feature collection to a data queue. The data queue is called short-term feature data set (labeled 1301*b*). When the data in the short-term feature data set reaches a certain amount, the older features are removed from short-term feature data set and stored through long-term feature collection to another data queue, called long-term feature data set (labeled 1301*c*). When the long-term feature data reaches a certain amount, the older feature data is discarded. The short-term and the long-term feature data sets are used for determining the camera tampering. The first step is to compute the tampering quantization (labeled 1302). For all the data in the short-term feature data set, compare any two data items (labeled 1302*a*) to compute a difference Ds. Compute all the average to obtain the average to obtain the average difference Ds'. Similarly, the average different Dl' is also computed for long-term feature data set. The pair-wise comparison may also be conducted for short-term and long-term feature data in a cross-computation to obtain average between-difference Db' (i.e., the difference between long-term and short-term feature data sets). Then, compute $Rct=Db'/(a\cdot Ds'+b\cdot Dl'+c)$ to obtain amount Rct in view-field change. The parameters a, b, c are for controlling the impact of the short-term and long-term average differences, with $a+b+c=1$. When "a" is larger, the situation indicates the hope that screen may appear unstable for a period of time after the tampering and to obtain the change information after screen stabilizes. When "b" is larger, the situation indicates the hope that screen may appear unstable for a period of time before the tampering. When "c" is larger, the situation indicates that regardless of the screen stability, the condition is determined to be a tampering event as long as there is obvious change.

Take this type of analysis as example. According to the definition of camera tampering feature, for example, the output features from the analysis may be enumerated as: view-field change vector (Rct) as 100, short-term average difference (Ds') as 101, long-term average difference (Dl') as 102, average between difference (Db') as 103, short-term feature data set as 104 and long-term feature data set=105. When the analysis result generated for an input is Rct=45, Ds'=30, Dl'=60, Db'=50, short-term feature data set=<30,22,43 . . . >, and long-term feature data set=<28,73,52, . . . >, then the resulted output feature set is {<100,45>, <101,30>, <102, 60>, <103,50>, <104, <30,22,43 . . . >>, <105, <28,73, 52, . . . >>}.

For out-of-focus estimation feature analysis algorithm, the out-of-focus screen will appear blurred. Therefore, this estimation is to estimate the blurry extent of the screen. For a screen, the effect of the blur is the originally sharp color or brightness change in the clear image will be less sharp. Therefore, the spatial color or brightness change can be computed to estimate the out-of-focus extent. A point p in the screen is selected as a reference point. Compute another point $p_N$ having a fixed distance ($d_N$) from p, and the another point $p_{N'}$ having the same distance from p but in opposite direction. For a longer distance $d_F$, compute two points $p_F$, $p_{F'}$ in the similar manner as $p_N$ and $p_{N'}$. Based on the near points ($p_N$, $p_{N'}$) and the far points ($p_F$, $p_{F'}$), the pixel values $V(p_N)$, $V(p_{N'})$, $V(p_F)$, $V(p_{F'})$ can be obtained for these points. The pixel value is a brightness value for grayscale image and a color vector for a color image. By using these pixel values, the out-of-focus estimation extent for reference p can be computed as follows:

$$DF(p) = \frac{d_N}{|V(p_N) - V(p'_N)|} \frac{|V(p_F) - V(p'_F)|}{d_F}$$

However, as this computation is only effective for reference points with obvious color or brightness change in neighboring pixels, the selection of reference points must be carefully conducted to estimate the out-of-focus extent. The selection basis for reference point is $a*|V(p_N)-V(p_{N'})|+b*|V(p_F)-V(p_{F'})|>Th_{DF}$, where $Th_{DF}$ is a threshold for selecting reference point. For input image, a fixed number ($N_{DF}$) of reference points are selected randomly or in a fixed-distance manner for evaluating the out-of-focus extent. To avoid the noise interference resulting in selecting non-representative reference points, a fixed ration number of reference points with lower estimation extent will be selected for computing the image out-of-focus extent. The method is to place the computed out-of-focus estimation for all reference points in order, and make sure a certain proportion of reference points with lower estimation extent will be selected for computing the average as the out-of-focus estimation for the overall image. The out-of-focus extent of the reference point used in the out-of-focus estimation is the feature required by the analysis.

Take this type of analysis as example. According to the definition by the camera tampering feature of the present invention, for example, the output feature of the analysis can be enumerated as: overall image out-of-focus as 200, reference points 1-5 out-of-focus extent as 201-205. When the analysis result generated for an input shows that overall image out-of-focus is 40, five reference points out-of-focus extent are 30, 20, 30, 50, 70, respectively, the resulted output feature set is expressed as {<200,40>,<201,30>,<202,20>, <203,30>,<204,50>,<205,70>}.

For brightness estimation feature analysis algorithm, the change in brightness will cause the image brightness to change. When the input image is in RGB format without separate brightness (grayscale), the sum of the three components of the pixel vector of the input image divided by three is the brightness estimation. If the input image is grayscale or component video format with separate brightness, the brightness may be obtained directly as the brightness estimation. The average brightness estimation of all the pixels in the image is the image brightness estimation. This estimation includes no separable feature.

Take this type of analysis as example. According to the definition by the camera tampering feature of the present invention, for example, the output feature of the analysis can be enumerated as: average brightness estimation as 300. When the analysis result generated for an input shows that average brightness estimation is 25, the resulted output feature is expressed as <300,25>.

For color estimation feature analysis algorithm, a general color image must include a plurality of colors. Therefore, the color estimation is to estimate the color change in the screen. If the input image is grayscale, this type of analysis is not performed. This estimation is performed on component video. If the input image is not component video, the image would be transformed into component video first, and then compute the standard deviation of the Cb and Cr components in the component video, and the one with the larger value is selected as the color estimation. The Cb and Cr values are the feature values of this estimation.

Take this type of analysis as example. According to the definition by the camera tampering feature of the present invention, for example, the output feature of the analysis can be enumerated as: color estimation as 400, Cb average as 401, Cr average as 402, Cb standard deviation as 403, and Cr standard deviation as 404. When the analysis result generated for an input shows that color estimation is 32.3, Cb average is 203.1, Cr average is 102.1, Cb standard deviation 21.7, and Cr standard deviation 32.3, the resulted output feature set is expressed as {<400,32.3>,<401,203.1>,<402,102.1>,<403, 21.7>, <404,32.3>}.

For movement estimation feature analysis algorithm, the movement estimation is to compute whether the movement of the camera causes the change of the scene. The movement estimation only computes the change of the scene caused by the camera change. To compute the change, an image at Δt earlier I(t−Δt) must be recorded and subtracts from the current image I(t) for pixel by pixel. If the input image is color image, the vector length after the vector subtraction is used as the result of subtraction. In this manner, a graph $I_{diff}$ of the image difference is obtained from the computation. By computing the diversity of the difference graph between the pixels, the change in the camera scene can expressed as:

$$MV = \frac{1}{N}\sum_{x,y}((I_{diff}(x, y)*x^2) + (I_{diff}(x, y)*y^2)) - \left(\frac{1}{N}\sum_{x,y} I_{diff}(x, y)*x\right)^2 - \left(\frac{1}{N}\sum_{x,y} I_{diff}(x, y)*y\right)^2$$

wherein x and y are the horizontal and vertical coordinates of the pixel location respectively, $I_{diff}(x,y)$ is the value of the difference graph at coordinates (x,y), and N is the number of pixels in computing this estimation. If all the pixels of the entire input image range are used for computation, N is equal to the number of the pixels in the image. The computed MV is the movement estimation of the image. The difference $I_{diff}$ of each sample on the estimation is the feature used by this analysis.

Take this type of analysis as example. According to the definition by the camera tampering feature of the present invention, for example, the output feature of the analysis can be enumerated as: movement estimation (MV) as 500, $I_{diff}$ of each sample point as 501. When the analysis result generated for an input shows that MV is 37, $I_{diff}$ of five sample points are <38,24,57,32,34> respectively, the output feature set is expressed as {<500,37>,<501, <38,24,57,32,34>>}.

Finally, for noise estimation feature analysis algorithm, the noise estimation is similar to movement estimation. The color different of the pixels is computed. Therefore, a difference image $I_{diff}$ is also computed. Then, a fixed threshold $T_{noise}$ is used to filter out the pixels with difference exceeding the threshold. These pixels are then combined to form a plurality of connected components. Arrange these connected components in size order and obtain a certain portion ($Tn_{num}$) of smaller connected components to compute the average size. According to the average size and the number of connected components, the noise ratio is computed as follows:

$$NO = c_{noise}\frac{Num_{noise}}{Size_{noise}}$$

where $Num_{noise}$ is the number of connected components, $Size_{noise}$ is the average size (in pixels) of a certain portion of smaller connected components, and $c_{noise}$ is the normalized constant. This estimation includes no separable independent feature.

Take this type of analysis as example. According to the definition by the camera tampering feature of the present invention, for example, the output feature of the analysis can be enumerated as: noise ratio estimation (NO) as 600. When the analysis result generated for an input shows that NO is 42, the output feature is expressed as <600,42>.

FIG. 14 shows a schematic view of an exemplary embodiment using a table to describe camera tampering event data set according to the present invention. As shown in the figure, the horizontal axis shows different camera tampering feature (ActionID), the vertical axis shows different camera tampering event (EventID), and the field corresponding to a specific EventID and ActionID indicates the criteria of the event, with N/A indicating no corresponding criteria. A tick field is placed in front of each EventID to indicate whether the camera tampering event requires detection. The ticked camera tampering event sets the properties of those with corresponding camera tampering feature criteria as requiring detection. A tick field is placed below each EventID. DO1 is the first GPIO output interface and DO2 is the second GPIO output interface. A ticked field indicates that the single must be outputted when the camera tampering event is satisfied.

FIG. 15 shows a schematic view of an exemplary embodiment inputting GPIO input signal according to one exemplary disclosed embodiment. As shown in FIG. 15, when using the present invention with GPIO input signal, the GPIO signal can be defined as a specific feature action (ActionID). The user can set the corresponding parameters to form event criteria. For example, if inputting a GPIO input signal to the present invention, the present invention defines the GPIO signal as DI1, and the user can set the corresponding criteria for DI1. On the other hand, the user may form new camera tampering event through combination according to the criteria corresponding to different features. For example, if the camera tampering analysis module of the present invention provides another movement estimation analysis unit to analyze the object moving information within the region of interest and provide criteria for moving object with output range restricted to 0-100 indicating the object velocity, the user may use the analysis unit to learn the velocity of the moving object within the video range to define whether a rope-tripping event has occurred (shown as rope-tripping 1 in FIG. 15). If the GPIO defined in the above exemplary embodiment is a infrared movement sensor, the above DI1 criteria may also be used to generate rope-tripping event (shown as rope-tripping 2 in FIG. 15). In addition, a plurality of criteria set can be used to avoid the false alarm caused by a single signal.

Figure 16:
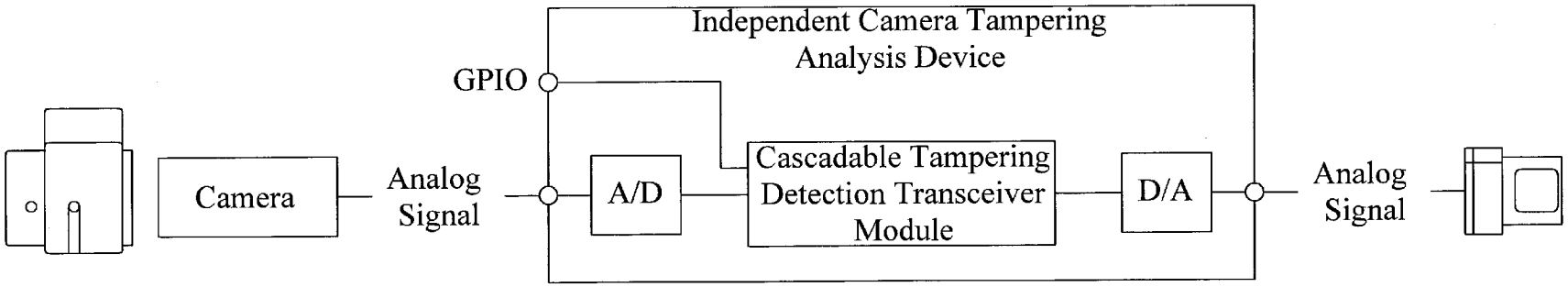
FIG. 16 shows a schematic view of applying the cascadable camera tampering detection transceiver module of the present invention to an independent camera tampering analysis device.

FIG. 16 shows a schematic view of applying the cascadable camera tampering detection transceiver module of the present disclosure to an independent camera tampering analysis device. In some environments with deployed cameras, additional device is added to analyze whether the monitored environment is sabotaged or the camera is tampered, and the analysis result is transmitted to the back-end surveillance host. In this type of application scenario, the present invention can be used as an independent camera tampering analysis device. The front-end video input to the present invention can be connected directly to A/D converter to convert the analog signal into digital signal. The back-end video output of the present invention can be connected to D/A converter to convert the digital signal into analog signal and then output the analog signal.

Figure 17:
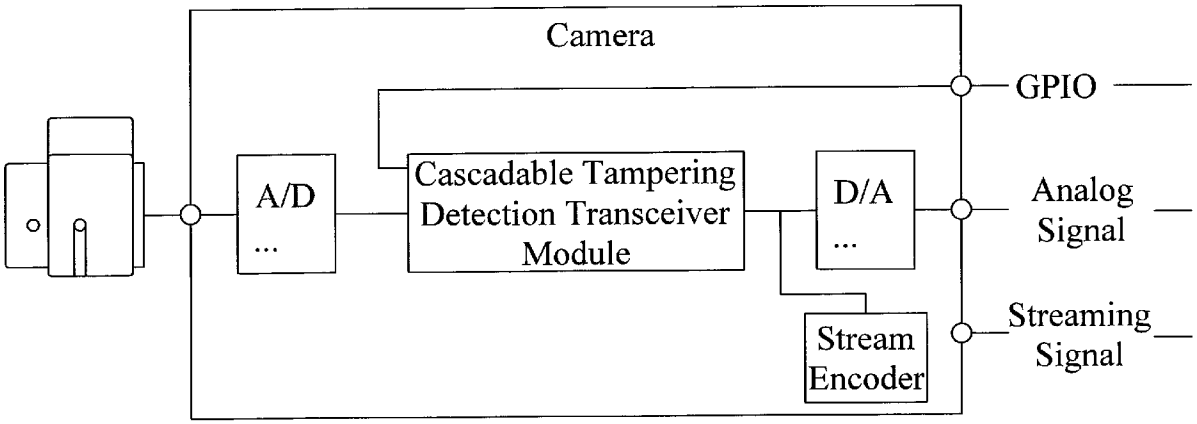
FIG. 17 shows a schematic view of applying the cascadable camera tampering detection transceiver module of the present disclosure to a camera tampering analysis device co-existing with a transmitting-end device.

FIG. 17 shows a schematic view of applying the cascadable camera tampering detection transceiver module of the present invention to a camera tampering analysis device co-existing with a transmitting-end device. As shown in FIG. 17, the present disclosed exemplary embodiments may be placed in a transmitting-end device. The transmitting-end device can be a camera. In this type of application scenario, the front-end video input to the present invention can be connected directly to A/D converter to convert the analog signal from the camera into digital signal. Dependent on the transmitting-end device, the back-end of the present invention can be connected to D/A converter to output the analog signal or use video compression for network streaming output.

Figure 18:
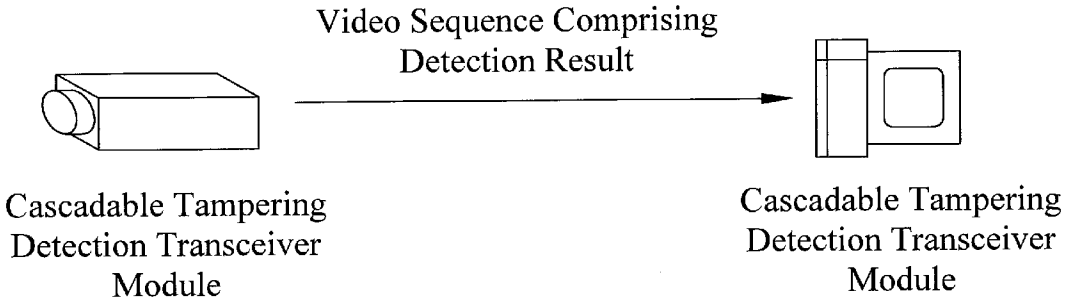
FIG. 18 shows a schematic view of applying the cascadable camera tampering detection transceiver module of the present invention to a camera tampering analysis device co-existing with a receiving-end device.

FIG. 18 shows a schematic view of applying the cascadable camera tampering detection transceiver module of the present disclosure to a camera tampering analysis device co-existing with a receiving-end device. In some application scenario, the surveillance camera may be a long distance from the surveillance host. As the deployment of cameras is more complicated, a possible scenario is that the camera is equipped with the module of the present disclosed exemplary embodiments and the surveillance host is also equipped with the module of the present disclosure. The module of the present invention installed inside camera may be called, for example, CTT1, and the module of the present invention installed at surveillance host may be called, for example, CTT2. CTT1 will output synthesized coded image. Because CTT1 only uses video transmission channel to transmit the video data to CTT2, CCT2 may analyze at input whether the input video includes coded image to determine whether further camera tampering analysis is necessary. In this architecture, both CTT1 and CTT2 can be completely identical devices, using the same settings. In this manner, CTT2 will be a signal relay that relays the video signal for output. To enhance the security level, the settings can be set to try detecting new coded image and analyze the uncoded image. In this case, when the front CTT1 is broken, changes settings, or malfunctions, CTT2 can still replace CTT1 to perform analysis processing.

In the architecture having transmitting-end and receiving-end devices, the present disclosure may change make CTT1 and CTT2 adopt different settings to avoid a large amount of computation to cause few frames analyzed each second. When CTT1 is set to omit the analysis on some camera tampering features, and CTT2 is set to analyze more or the entire features, CTT2 may omit some of the analysis based on the decoded information, and then proceed with additional analysis. In this kind of architecture, the tampering information outputted by CTT1 will include analyzed features and the analysis result values, and CTT2, after receiving, will determine which analysis modules have already analyzed the images based on the index of each value. Therefore, on CTT2 only processes yet analyzed modules. The FIG. 14 as example, CTT2 is set to analyze the "covered" and CTT1 is set to analyze the "out-of-focus". With only five reference points for out-of-focus estimation (as in the previous exemplar), enumerated 201, 202, 203, 204, 205, with values as 30, 20, 30, 50 and 70, respectively. The overall image has an out-of-focus extent quantization enumerated as 200, with value as 40. When CTT2 receives the video and reads the tampering information, CTT2 can determine that the value for index 200 is 40. To analyze the "covered" in FIG. 14, the computation only needs to compute view field change, brightness estimation, and color estimation.

In summary, the disclosed exemplary embodiments provide a cascadable camera tampering detection transceiver module. With only digital input video sequence, the disclosed exemplary embodiments may detect camera tampering event, generate camera tampering information, make a graph of camera tampering feature and synthesize the video sequence, and finally output the synthesized video. The main feature of the present disclosure is to transmit camera tampering event and related information through video.

The present disclosure provides a cascadable camera tampering detection transceiver module. If the input video sequence is an output from the present invention, the present invention rapidly separate the camera tampering information from the input video sequence so that the existing camera tampering information can be used to add or enhance the video analysis to achieve the object of cascadability to avoid repeating analyzing the already analyzed and to allow the user to redefine the determination criteria.

The present disclosure provides a cascadable camera tampering detection transceiver module. With only video channel for transmitting camera tampering information in graphic format to the personnel or the module of the present invention at the receiving-end.

The present disclosure provides a cascadable camera tampering detection transceiver module, with both transmitting and receiving capabilities so that the present disclosure may be easily combined with different types of surveillance devices with video input or output interfaces, including analog camera. In this manner, the analog camera is also equipped with the camera tampering detection capability instead of grading to higher-end products.

In comparison with conventional technologies, the cascadable camera tampering detection transceiver module of the present disclosure has the following advantages: using graphic format to warn the user of the event, able to transmit event and other quantized information, not requiring transmission channels other than video channel, and cascadable for connection and able to perform cascadable analysis.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A camera tampering detection transceiver module for receiving input video sequence, generating camera tampering feature, synthesizing camera tampering information with said input video sequence and outputting synthesized video sequence, said camera tampering detection transceiver module comprising:

a processor; and a data storage device, said data storage device storing:

a camera tampering image transceiving module, for receiving said input video sequence, decoding camera tampering image from said input video sequence, separating said camera tampering image from said input video sequence, synthesizing said camera tampering image with said input video sequence, and output said synthesized video sequence;

an information control module, connected to said camera tampering image transceiving module, for accessing camera tampering feature of said input video sequence, determining camera tampering event and selecting whether to output said input video sequence directly or synthesize and output synthesized video sequence; and a camera tampering analysis module, connected to and controlled by said information control module for determining whether to analyze said input video sequence and generate camera tampering feature to provide to said information control module for determination;

wherein said processor is able to execute said camera tampering image transceiving module, said information control module and said camera tampering analysis module stored in said data storage device; and wherein said information control module further includes:

a camera tampering feature description unit, for storing a plurality of camera tampering feature information; and an information filtering element, connected to said camera tampering feature description unit, said camera tampering image transceiving module and said camera tampering analysis module, for receiving and filtering requests from said camera tampering image transceiving module to access said camera tampering feature information in said camera tampering feature description unit, and determining whether to activate functions of said camera tampering analysis module.

2. The camera tampering detection transceiver module as claimed in claim 1, wherein said camera tampering image transceiving module further includes:

a camera tampering image separation element, for receiving said input video sequence, detecting and separating tampering image and non-tampering image of said input video sequence, said tampering image being processed by a camera tampering image transformation element, said non-tampering image being processed by said information control module or said camera tampering analysis module;

a camera tampering image transformation element, connected to said camera tampering image separation element, for transforming said tampering image into tampering feature or tampering event if tampering image existing;

a synthesis description setting unit, for storing a plurality of descriptions of manners of synthesizing; and a camera tampering image synthesis element, connected to said synthesis description setting unit, said information control module and said camera tampering image transformation element, for receiving said input video sequence, synthesizing said input video sequence according to said descriptions of manners of synthesizing stored in said synthesis description setting unit, and outputting said synthesized video sequence;

wherein output video of said camera tampering image transceiving module being from said camera tampering image synthesis element, said camera tampering image separation element, or said original input video sequence; and a multiplexer being used to control connecting said above three output videos to output of said information control module, input of said camera tampering analysis module or input of said camera tampering image synthesis element according to computation result.

3. The camera tampering detection transceiver module as claimed in claim 1, wherein said camera tampering image transceiving module is to transform said camera feature or said camera tampering event into a graphic, synthesize said graphic with said video sequence and output said synthesized video sequence.

4. The camera tampering detection transceiver module as claimed in claim 3, wherein said graphic is a two-dimensional barcode.

5. The camera tampering detection transceiver module as claimed in claim 1, wherein camera tampering analysis module further includes a plurality of camera tampering analysis units, each said camera tampering analysis unit performs a different analysis and feeds analysis result back to said information filtering element of said information control module.

6. The camera tampering detection transceiver module as claimed in claim 2, wherein said camera tampering image separation element performs subtraction between two consecutive images of said input video sequence to compute difference of each pixel between said two images, sets a threshold to filter said pixels, uses connected component extraction method to find connected components formed by said pixels, filters out over-large and over-small connected components, and filters remaining connected components by comparing shape, and obtained result is coded image candidate.

7. A camera tampering detection transceiver module for receiving input video sequence, generating camera tampering feature, synthesizing camera tampering information with said input video sequence and outputting synthesized video sequence, said camera tampering detection transceiver module comprising:

a processor; and a data storage device, said data storage device storing:

a camera tampering image transceiving module, for receiving said input video sequence, decoding camera tampering image from said input video sequence, separating said camera tampering image from said input video sequence, synthesizing said camera tampering image with said input video sequence, and output said synthesized video sequence;

an information control module, connected to said camera tampering image transceiving module, for accessing camera tampering feature of said input video sequence, determining camera tampering event and selecting whether to output said input video sequence directly or synthesize and output synthesized video sequence; and a camera tampering analysis module, connected to and controlled by said information control module for determining whether to analyze said input video sequence and generate camera tampering feature to provide to said information control module for determination;

wherein said processor is able to execute said camera tampering image transceiving module, said information control module and said camera tampering analysis module stored in said data storage device;

wherein said camera tampering image transceiving module further includes:

a camera tampering image separation element, for receiving said input video sequence, detecting and separating tampering image and non-tampering image of said input video sequence, said tampering image being processed by a camera tampering image transformation element, said non-tampering image being processed by said information control module or said camera tampering analysis module;

a camera tampering image transformation element, connected to said camera tampering image separation element, for transforming said tampering image into tampering feature or tampering event if tampering image existing;

a synthesis description setting unit, for storing a plurality of descriptions of manners of synthesizing; and a camera tampering image synthesis element, connected to said synthesis setting description unit, said information control module and said camera tampering image transformation element, for receiving said input video sequence, synthesizing said input video sequence according to said descriptions of manners of synthesizing stored in said synthesis description setting unit, and outputting said synthesized video sequence;

wherein output video of said camera tampering image transceiving module being from said camera tampering image synthesis element, said camera tampering image separation element, or said original input video sequence; and a multiplexer being used to control connecting said above three output videos to output of said information control module, input of said camera tampering analysis module or input of said camera tampering image synthesis element according to computation result;

wherein said camera tampering image separation element uses an image mask method to compute difference and filter qualified pixels, sets a threshold to filter said pixels, uses connected component extraction method to find connected components formed by said pixels, filters out over-large and over-small connected components, and filters remaining connected components by comparing shape, and obtained result is coded image candidate; and wherein said coded image has a shape of rectangle or square, said operation of filtering remaining connected components by comparing shape is based on computing similarity of said connected component and a square, said similarity is expressed as $N_{pt}/(W\times H)$, $N_{pt}$ is the number of pixels in said connected component, W and H are the farthest distance between two points of said connected component along horizontal and vertical axis respectively.

8. The camera tampering detection transceiver module as claimed in claim 7, wherein said camera tampering image transformation element first executes tampering image detection, transforms tampering image into tampering feature or tampering event or transforms tampering feature or tampering event into tampering image to ensure size and range of coded image, and uses as a basis for performing restoration to remove coded image from said input video sequence.

9. The camera tampering detection transceiver module as claimed in claim 7, wherein said camera tampering image synthesis element is to execute:

selecting synthesis time according to said synthesis setting description unit;

analyzing whether synthesized coded image required at said synthesis time;

when not required, outputting said input video sequence directly, when requiring synthesized, selecting display style of coded image via synthesis mode selection and using camera tampering image transformation element to perform coding to generate coded image;

selecting location of said coded image via synthesis location selection; and placing said coded image into video image to accomplish synthesis and outputting said synthesized image as current frame in said video sequence.

10. The camera tampering detection transceiver module as claimed in claim 1, wherein said camera tampering feature description unit stores a camera tampering feature value set, a camera tampering event definition set and a set of actions requiring detection.

11. The camera tampering detection transceiver module as claimed in claim 10, wherein said camera tampering feature value set further includes a plurality of camera tampering features, and each camera tampering feature is expressed as a <index, value> tuple, wherein index is an index and is an integer or string data, value is a value corresponding to said index, and is chosen from a group of Boolean, integer, floating point number, string and binary data, or another data set; said camera tampering event definition set further includes a plurality of camera tampering events, and each said camera tampering event is expressed as <EventID, criteria> tuple, EventID corresponds to camera tampering feature index, indicating event index, and is an integer or string data, criteria corresponds to value of camera tampering feature, indicating corresponding event criteria corresponded to said event index; said set of actions requiring detection further includes a plurality of actions requiring detection, and each said action requiring detection is expressed as ActionID.

12. The camera tampering detection transceiver module as claimed in claim 1, wherein after said information control module receives separated image and tampering feature from said camera tampering image transceiving module, said information filtering element executes the following steps of:

(a) deleting old analysis results and data no longer useful in said camera tampering feature description unit;

(b) adding new feature data by storing received tampering features to said camera tampering feature description unit;

(c) obtaining camera tampering event definition from said camera tampering feature description unit;

(d) checking every event criterion, according to said obtained tampering event definition, listing each event criterion and search for corresponding camera tampering feature value tuple in said camera tampering feature description unit according to said event criterion;

(e) determining whether all said event criteria being computable, if not, proceeding to step (f); otherwise, proceeding to step (i);

(f) checking lacking feature and finding the corresponding camera tampering analysis unit in said camera tampering analysis module to obtain said lacking tampering feature;

(g) selecting video source for video analysis according to user setting;

(h) calling corresponding camera tampering analysis unit, and for said corresponding camera tampering analysis unit in camera tampering analysis module to perform analysis and returning result, and then executing step (b);

(i) determining whether event criterion being satisfied, if so, executing step (j); otherwise, executing step (k);

(j) adding warning information to feature data set; and (k) selecting output video selection according to user-set output video selections, and transmitting to said camera tampering image transceiving module for image synthesis or output.

13. The camera tampering detection transceiver module as claimed in claim 12, wherein said information filtering element provides the following functions:

adding, setting or deleting features in said camera tampering feature description unit;

providing default values to said camera tampering feature value set inside data camera tampering feature description unit;

providing determination mechanism for calling said camera tampering analysis module;

providing determination mechanism for calling said camera tampering event;

providing determination mechanism for calling said camera tampering image transceiving module, when all camera tampering events requiring detection being determined, execution passed to said camera tampering image synthesis element of said camera tampering image transceiving module;

providing determination mechanism for input video to said camera tampering analysis module;

providing determination mechanism for output video; and providing determination mechanism for input video sequence to said camera tampering image synthesis element.

14. The camera tampering detection transceiver module as claimed in claim 13, wherein determination mechanism for calling said camera tampering analysis module further includes:

obtaining ActionID set requiring determination in said camera tampering feature description unit;

for each element in said ActionID set requiring determination, obtaining corresponding value in said camera tampering feature description unit to obtain {<ActionID, corresponding_value>+} value set;

if any element in said ActionID set requiring determination unable to obtain corresponding value, said {<ActionID, corresponding_value>+} being passed to said camera tampering analysis module for execution, and waiting until said camera tampering analysis module completing execution.

15. The camera tampering detection transceiver module as claimed in claim 13, wherein said determination mechanism for calling said camera tampering event further includes:

checking whether camera tampering event <EventID, criteria> satisfying corresponding criteria, and said checking further including:

if corresponding criteria is <ActionID, properties, min, max> tuple, corresponding property value of ActionID must be between min and max to satisfy said criteria; and if corresponding criteria is <ActionID, properties, {criterion*}> tuple, corresponding property value of ActionID must be within {criterion*} to satisfy said criteria.

16. The camera tampering detection transceiver module as claimed in claim 13, wherein determination mechanism for input video sequence to said camera tampering analysis module further includes:

when said information filtering element defining output reconstruction required, said input video sequence being connected to output of said camera tampering image separation element of said camera tampering image transceiving module; and when said information filtering element defining said source video being required to be outputted, said input video sequence being connected to input video of said camera tampering image transceiving module.

17. The camera tampering detection transceiver module as claimed in claim 13, wherein determination mechanism for output video further includes:

when said information filtering element defining synthesized video being required to be outputted, said output video being connected to output of said camera tampering image synthesis element of said camera tampering image transceiving module;

when said information filtering element defining output reconstruction being required, said output video being connected to output of said camera tampering image separation element of said camera tampering image transceiving module; and when said information filtering element defining source video having to be outputted, said output video being connected to input video of said camera tampering image transceiving module.

18. The camera tampering detection transceiver module as claimed in claim 13, wherein said determination mechanism for said input video sequence to said camera tampering synthesis element further includes:

when said information filtering element defining output reconstruction being required, said input video being connected to output of said camera tampering image separation element of said camera tampering image transceiving module; and when said information filtering element defining source video being required to be outputted, input video being connected to input video of said camera tampering image transceiving module.

* * * * *